US010610838B2

(12) United States Patent
Tang

(10) Patent No.: US 10,610,838 B2
(45) Date of Patent: Apr. 7, 2020

(54) METHOD AND DEVICE FOR EMULSIFYING EMULSION EXPLOSIVE

(71) Applicant: SHIJIAZHUANG SUCCESS MACHINERY ELECTRICAL CO., LTD., Shijiazhuang, Hebei (CN)

(72) Inventor: Qiuming Tang, Shijiazhuang (CN)

(73) Assignee: SHIJIAZHUANG SUCCESS MACHINERY ELECTRICAL CO., LTD., Shijiazhuang (CN)

( * ) Notice: Subject to any disclaimer, the term of this patent is extended or adjusted under 35 U.S.C. 154(b) by 0 days.

(21) Appl. No.: 16/017,269

(22) Filed: Jun. 25, 2018

(65) Prior Publication Data

US 2018/0369763 A1 Dec. 27, 2018

Related U.S. Application Data

(62) Division of application No. 14/779,580, filed as application No. PCT/CN2014/073808 on Mar. 21, 2014.

(30) Foreign Application Priority Data

Sep. 26, 2013 (CN) ..... 2013 1 0446385

(51) Int. Cl.
*B01F 5/06* (2006.01)
*C06B 47/14* (2006.01)
(Continued)

(52) U.S. Cl.
CPC ..... *B01F 5/0602* (2013.01); *B01F 3/0807* (2013.01); *B01F 5/048* (2013.01);
(Continued)

(58) Field of Classification Search
CPC .... B01F 5/0602; B01F 3/0807; B01F 4/0453; B01F 5/0458; B01F 5/0473; B01F 5/0493;
(Continued)

(56) References Cited

U.S. PATENT DOCUMENTS 4,491,489 A 1/1985 Ellis et al.
5,834,539 A 11/1998 Krivohlavek
(Continued)

FOREIGN PATENT DOCUMENTS

WO 2007/086950 A2 8/2007

OTHER PUBLICATIONS

Jun. 27, 2014 International Search Report issued in International Patent Application No. PCT/CN2014/073808.
(Continued)

*Primary Examiner* — Tony G Soohoo
*Assistant Examiner* — Elizabeth Insler
(74) *Attorney, Agent, or Firm* — Oliff PLC

(57) ABSTRACT

The present invention relates to a method and device for emulsifying emulsion explosive: an oil phase and a part of a water phase having undergone split-flow enter a first stage coarse emulsion mixer; after mixing, the mixture together with a part of the water phase having undergone second stage split-flow enters a second stage coarse emulsion mixer; the obtained mixture together with a part of the water phase having undergone third stage split-flow enters a third stage coarse emulsion mixer for mixing; forming a coarse emulsion matrix after multiple stages of mixing, and finally completing emulsification after mixing in a multi-stage fine emulsion mixer. The method and device mix the water phase with the oil phase multiple times according to a desired ratio, thus greatly reducing the stored explosive, with no mechanical stirring or shearing, with no heat accumulation, and with
(Continued)

low pressure, without requiring matrix pumping, thus enhancing safety.

4 Claims, 2 Drawing Sheets

(51) Int. Cl.

| | |
|---|---|
| ***C06B 21/00*** | (2006.01) |
| ***B01F 15/02*** | (2006.01) |
| ***B01F 5/04*** | (2006.01) |
| ***B01F 3/08*** | (2006.01) |
| ***B01F 13/10*** | (2006.01) |

(52) U.S. Cl.
CPC ..... *B01F 5/0413* (2013.01); *B01F 5/0473* (2013.01); *B01F 5/0688* (2013.01); *B01F 13/1027* (2013.01); *B01F 15/0243* (2013.01); *C06B 21/0008* (2013.01); *C06B 47/145* (2013.01); *B01F 2003/0849* (2013.01); *B01F 2015/0221* (2013.01); *B01F 2215/0057* (2013.01)

(58) Field of Classification Search
CPC ..... B01F 5/0646; B01F 3/0861; B01F 2015/0221; C06B 47/145; C06B 21/0008
USPC ..... 366/165.1
See application file for complete search history.

(56) References Cited

U.S. PATENT DOCUMENTS

| | | | | |
|---|---|---|---|---|
| 6,443,610 | B1 | 9/2002 | Shechter et al. | |
| 9,458,066 | B2 * | 10/2016 | Goodridge | B01F 3/0807 |
| 2005/0282914 | A1 * | 12/2005 | Reed | C08J 3/03 516/53 |
| 2010/0296362 | A1 * | 11/2010 | Halander | C06B 21/0008 366/162.4 |
| 2011/0126462 | A1 * | 6/2011 | Livshits | B01F 5/0062 48/87 |

OTHER PUBLICATIONS

Aug. 18, 2015 Office Action issued in Chinese Patent Application No. 201310446385.X.
Feb. 23, 2018 Office Action issued in U.S. Appl. No. 14/779,580.
Sep. 5, 2018 Office Action issued in U.S. Appl. No. 14/779,580.
Jun. 19, 2017 extended European Search Report issued in European Application No. 14847327.5.

* cited by examiner

METHOD AND DEVICE FOR EMULSIFYING EMULSION EXPLOSIVE

CROSS-REFERENCE TO RELATED APPLICATIONS

This is a Division of application Ser. No. 14/779,580 filed Sep. 24, 2015, which in turn is a national stage entry of PCT/CN2014/073808 filed Mar. 21, 2014, which claims priority to CN 201310446385.X filed Sep. 26, 2013. The disclosure of each of the prior applications is hereby incorporated by reference herein in its entirety.

FIELD OF THE INVENTION

The present invention relates to the production field of emulsion explosive, and more particularly relates to a method and device for emulsifying emulsion explosive.

BACKGROUND OF THE INVENTION

Due to the outstanding adaptability and safety performance, emulsion explosive has become one of the dominant varieties of industrial explosives after the vigorous development of nearly 40 years. Currently, during the production process of emulsion explosive, a stator-rotor shear-type emulsifying method is usually adopted for preparing an emulsion matrix. The axial clearance and radial clearance between a stator and a rotor are from 1 mm to 8 mm, some even less than 1 mm. While a stator-rotor shear-type emulsifying device is working, the rotor rotates at high speed of 1400~3000 r/min, so during the process of flowing through hermetically sealed cavities of the device, the material is exposed to strong effects such as mechanical shearing and impact friction between a stator and a rotor, resulting in dispersive emulsification. But due to narrow clearances between a stator and a rotor inside the device, as well as relatively sealed cavities, strong effects such as mechanical shearing and impact friction formed by the rotor rotation at high speed easily lead to heat accumulation. When the heat accumulation reaches up to a certain extent, explosion easily happens. In addition, due to high shear strength of the emulsion matrix and high viscosity of the colloid, the emulsion matrix is often transported at high pressure by means of transportation equipments such as screw pumps when an emulsion is refined, at the same time, it is required that safety protection shutdown devices such as discontinuous flow, overtemperature and overpressure should be provided, leading to equipment complexity and high potentiality for security problems.

SUMMARY

The present invention is designed to provide a new method and device for emulsifying emulsion explosive, without requiring mechanical stirring or colloid pumping, improving the security of emulsion explosive production.

The method of the invention adopts the following technical solutions, see FIG. 1, a method for emulsifying emulsion explosive, comprising the following steps of: from an oil phase tank, letting an oil phase enter a first stage coarse emulsion mixer in accordance with full proportion of the explosive through an oil phase pump, from a water phase tank, letting a water phase enter a multi-stage coarse emulsion mixer by multiple times in accordance with certain proportions of the explosive through a water phase pump in the manner of multi-stage split-flow; keeping a last stage coarse emulsion mixer connected to a fine emulsion mixer; mixing emulsion matrix in a multi-stage fine emulsion mixer before completing the emulsification;

The proportions of the oil phase and water phase are controlled by the oil phase pump and the water phase pump, respectively.

The split-flow of the water phase comprises a first stage adjustment of flow rate, a second stage adjustment of flow rate, a third stage adjustment of flow rate and so on, for controlling the flow rate of the water phase entering the coarse emulsion mixer of each stage.

An oil phase and a part of the water phase firstly enter the first stage coarse emulsion mixer, after being mixed, the mixture together with a second part of the water phase controlled to discharge by the second stage adjustment of flow rate, enters the second stage coarse emulsion mixer, and then the obtained mixture together with a third part of the water phase discharged from the third stage adjusting control of flow rate enters the third stage coarse emulsion mixer for mixing.

The total flow rate under the adjusting control, including the first stage adjustment of flow rate, the second stage adjustment of flow rate and the third stage adjustment of flow rate, refers to the flow rate under the adjusting control of the total water phase flow rate, and the flow rates among all stages of adjustment are allocated proportionately.

The multi-stage coarse emulsion mixer has at least 3 stages, and the multi-stage fine emulsion mixer has 1-5 stages.

The multi-stage coarse emulsion mixer has preferably 5-7 stages, and the multi-stage fine emulsion mixer has preferably 3 stages.

The coarse emulsion mixer is a static mixer, an orifice plate or a Venturi tube.

The fine emulsion mixer is a static mixer, an orifice plate or a Venturi tube.

The total flow rates of the oil phase and the water phase that are mixed for emulsification are 4%-10% and 90%-96% in weight percentage, respectively.

The device of the invention can be realized by using the following technical solutions: an emulsifying device for an emulsion explosive, comprising an oil phase storage tank 60, a water phase storage tank 70, a multi-stage coarse emulsion mixer and a multi-stage fine emulsion mixer 600; the oil phase storage tank 60 and water phase storage 70 are equipped with an oil phase flow rate regulating pump 90 and a total water phase flow rate regulating pump 80, respectively; every two adjacent stages of coarse emulsion mixers are connected in series; each stage of coarse emulsion mixer is equipped with its own flow rate adjustment; and the last stage coarse emulsion mixer is connected to the fine emulsion mixer.

The multi-stage coarse emulsion mixer has at least 3 stages, and the fine emulsion mixer has 1-5 stages.

The multi-stage coarse emulsion mixer has preferably 5-7 stages, and the fine emulsion mixer has preferably 3 stages.

The multi-stage coarse emulsion mixer includes a first stage coarse emulsion mixer 100, a second stage coarse emulsion mixer 200, and a third stage coarse emulsion mixer 300, equipped with the first stage adjustment of flow rate, the second stage adjustment of flow rate and the third stage adjustment of flow rate, respectively.

The total flow rate under the control of the first stage adjustment of flow rate, the second stage adjustment of flow rate and the third stage adjustment of flow rate refers to the flow rate under the control of the total water phase flow rate regulating pump 80, and the flow rates among all stages of flow rate adjustment are allocated proportionately.

The coarse emulsion mixer is a static mixer, an orifice plate or a Venturi tube.

The fine emulsion mixer 600 is a static mixer, an orifice plate or a Venturi tube.

The total flow rates of the oil phase and the water phase that are mixed for emulsification are 4%-10% and 90%-96% in weight percentage, respectively.

The purposes of the invention can be realized by the device of FIG. 2: the oil phase enters with full proportion from the initial end 1, the water phase with about ⅕ of the normal proportions enters laterally from the diversion port 2, spouts from the jet hole 3 at a certain flow velocity, and strikes the oil phase, then the mixture spouts from the orifice plate 4 at a certain flow velocity, forming the first stage coarse emulsion 101; the spew is further collided and mixed with a second part of the water phase with about ⅕ of the normal proportions that enters from the diversion port 5 and spouts from the jet hole 6 at a certain flow velocity, then the obtained mixture spouts from the orifice plate 7 at a certain flow velocity, forming the second stage coarse emulsion 201; the spew is further collided and mixed with a second part of the water phase with about ⅕ of the normal proportions that enters from the diversion port 8 and spouts from the jet hole 9 at a certain flow velocity, then the obtained mixture spouts from the orifice plate 10 at a certain flow velocity, forming the third stage coarse emulsion 301; the spew is further collided and mixed with a second part of the water phase with about ⅕ of the normal proportions that enters from the diversion port 11 and spouts from the jet hole 12 at a certain flow velocity, then the obtained mixture spouts from the orifice plate 13 at a certain flow velocity, forming the fourth stage coarse emulsion 401; the spew is further collided and mixed with a second part of the water phase with about ⅕ of the normal proportions that enters from the diversion port 14 and spouts from the jet hole 15 at a certain flow velocity, then the obtained mixture spouts from the orifice plate 16 at a certain flow velocity, forming the fifth stage coarse emulsion 501. At last, the spew enters from the fine emulsion orifice plate 17 and spouts from the jet hole 18 at a certain flow velocity to form a fine emulsion 601, in this way the emulsification process is completed.

The invention does not need mechanical stirring or shearing and colloid pumping devices, letting the water phase mix with the oil phase by multiple times through control strategies of flow rate adjustment in the multi-stage coarse emulsion mixer, making the oil phase mix thoroughly with a smaller amount of the water phase every time, and finally the relatively homogeneous mixing with the entire oil phase is realized at low temperature and low pressure, the obtained mixture is further subjected to thorough mixing in a multi-stage fine emulsion mixer before getting the colloid matrix with the particle size of about 1 micrometer. The method and device make the water phase to be mixed with the oil phase multiple times according to a desired ratio, improve the mixing pattern by transforming the traditional single mixing into multiple mixing, thus greatly reducing the stored explosive, with no mechanical stirring or shearing, not leading to heat accumulation, with low pressure, without requiring matrix pumping, thus enhancing safety.

DETAILED DESCRIPTION OF EMBODIMENTS

Figure 1:
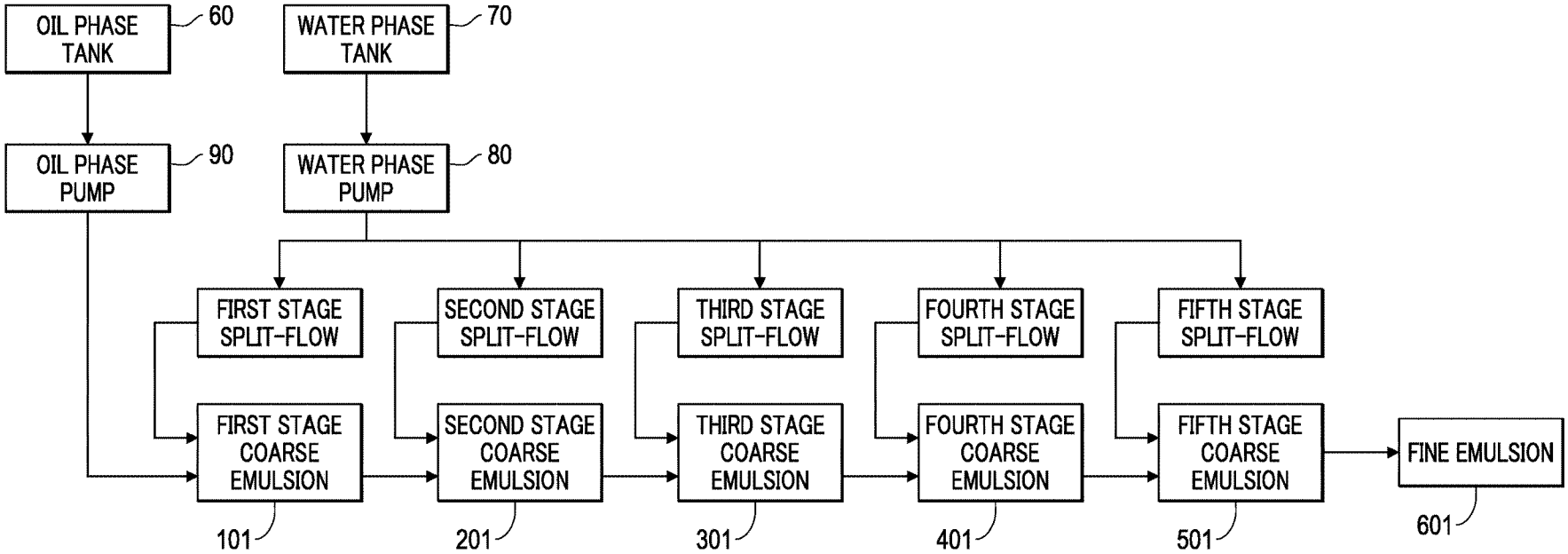
FIG. 1 is a schematic view of 5-stage coarse emulsion emulsifying technology of the present invention.
Figure 2A:
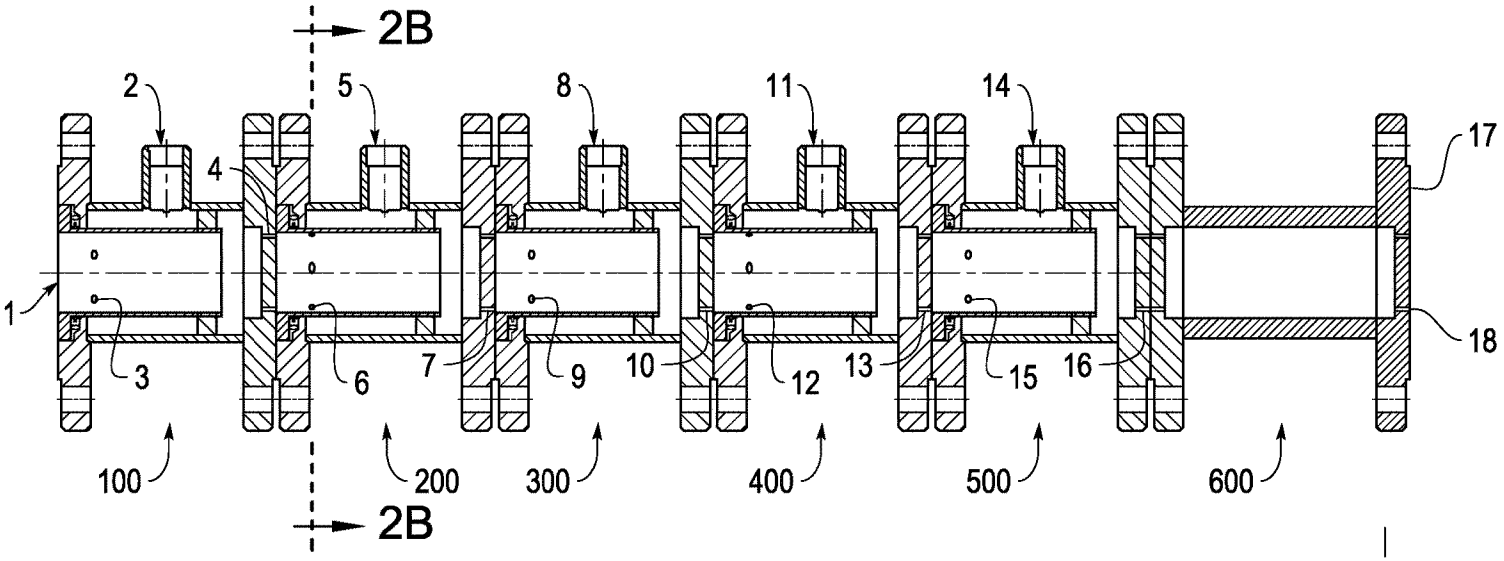
FIG. 2A is a schematic view of a structure of a 5-stage coarse emulsion emulsifying device of the present invention.
Figure 2B:
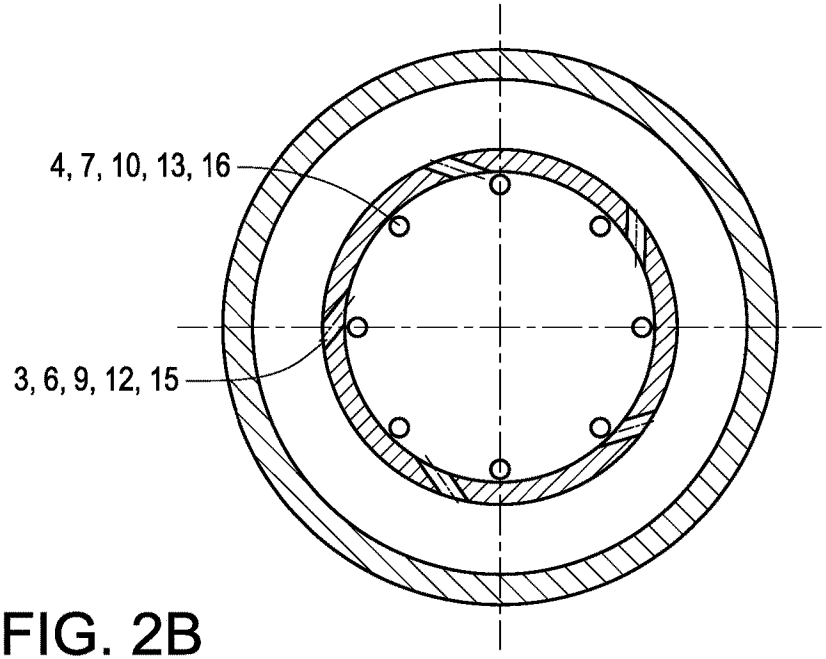
FIG. 2B is a cross-sectional view of a coarse emulsion mixer along cut line 2B-2B.

A 5-stage coarse emulsion emulsifying device shown in FIG. 1 is used to perform 5-stage coarse emulsion emulsification: the oil phase enters with full proportion from the initial end 1, the water phase with about ⅕ of the normal proportions enters laterally from the diversion port 2, spouts from the jet hole 3 at a certain flow velocity, and strikes the oil phase, then the mixture spouts from the orifice plate 4 at a certain flow velocity, forming the first stage coarse emulsion; the spew is further collided and mixed with a second part of the water phase with about ⅕ of the normal proportions that enters from the diversion port 5 and spouts from the jet hole 6 at a certain flow velocity, then the obtained mixture spouts from the orifice plate 7 at a certain flow velocity, forming the second stage coarse emulsion; the spew is further collided and mixed with a second part of the water phase with about ⅕ of the normal proportions that enters from the diversion port 8 and spouts from the jet hole 9 at a certain flow velocity, then the obtained mixture spouts from the orifice plate 10 at a certain flow velocity, forming the third stage coarse emulsion; the spew is further collided and mixed with a second part of the water phase with about ⅕ of the normal proportions that enters from the diversion port 11 and spouts from the jet hole 12 at a certain flow velocity, then the obtained mixture spouts from the orifice plate 13 at a certain flow velocity, forming the fourth stage coarse emulsion; the spew is further collided and mixed with a second part of the water phase with about ⅕ of the normal proportions that enters from the diversion port 14 and spouts from the jet hole 15 at a certain flow velocity, then the obtained mixture spouts from the orifice plate 16 at a certain flow velocity, forming the fifth stage coarse emulsion. At last, the spew enters from the fine emulsion orifice plate 17 and spouts from the jet hole 18 at a certain flow velocity, in this way the emulsification process is completed.

In order to provide a better understanding of the invention, through specific embodiments below the present invention will be illustrated in detail.

Embodiment 1

A Venturi tube is adopted as the mixer, the stage number of coarse emulsion is 7, and the stage number of fine emulsion is 1. The total flow rates of the oil phase and the water phase that are mixed are 10% and 90% in weight percentage, respectively. During the phase of coarse emulsion, the water phase is divide into 7 equal parts and added into the mixer by seven times. The flow velocities of coarse emulsion and fine emulsion are 10 m/s and 20 m/s, respectively, the production capacity is 5 tons per hour. Experimental results: the viscosities of coarse emulsion and fine emulsion are 800 cp and 3300 cp, respectively, the systematic pressure is 1.5 Mpa. The viscosity of final colloid is equal to that of mechanical shearing at the linear velocity of 15 m/s.

Embodiment 2

An SV type static mixer is adopted as the mixer, the stage number of coarse emulsion is 5, and the stage number of fine emulsion is 3. The total flow rates of the oil phase and the water phase that are mixed are 8% and 92% in weight percentage, respectively. During the phase of coarse emulsion, the water phase is divide into 5 equal parts and added into the coarse emulsion static apparatus by five times. The flow velocities of coarse emulsion and fine emulsion are 10 m/s and 20 m/s, respectively, the production capacity is 5 tons per hour. Experimental results: the viscosities of coarse emulsion and fine emulsion are 1000 cp and 2600 cp, respectively, the systematic pressure is 3.8 Mpa. The viscosity of final colloid is equal to that of mechanical shearing at the linear velocity of 12 m/s.

Embodiment 3

An orifice plate is adopted as the mixer, the stage number of coarse emulsion is 3, and the stage number of fine emulsion is 5. The total flow rates of the oil phase and the water phase that are mixed are 4% and 96% in weight percentage, respectively. During the phase of coarse emulsion, the water phase is divide into 3 equal parts and added into the coarse emulsion static apparatus by three times. The flow velocities of coarse emulsion and fine emulsion are 15 m/s and 20 m/s, respectively, the production capacity is 5 tons per hour. Experimental results: the viscosities of coarse emulsion and fine emulsion are 1900 cp and 3300 cp, respectively, the systematic pressure is 1.2 Mpa. The viscosity of final colloid is equal to that of mechanical shearing at the linear velocity of 20 m/s.

Obviously, the above embodiments are for purpose of clear illustration and are not intended to limit the embodiment mode. It will be obvious to those skilled in the art that changes and modifications may be made without departing from the invention in its broader aspects, and, therefore, the aim of the appended claims is to cover all such changes and modifications as fall within the true spirit and scope of the invention.

What is claimed is:

1. An emulsifying device for an emulsion explosive, comprising:

(i) an oil phase storage tank equipped with an oil phase flow rate regulating pump, (ii) a water phase storage tank equipped with a total water phase flow rate regulating pump, (iii) a multi-stage coarse emulsion mixer including:

(a) a first stage coarse emulsion mixer equipped with:

an oil inlet disposed at an end of the multi-stage coarse emulsion mixer, the oil inlet being configured to allow an oil phase to enter at its full proportion into the first stage coarse emulsion mixer, a first stage adjustment of flow rate configured to control a first part of a water phase to flow into the first stage coarse emulsion mixer, a first diversion port configured to laterally introduce the first part of the water phase into the first stage coarse emulsion mixer, a first jet hole configured to cause the first part of the water phase to spout from the first jet hole at a certain flow velocity and to laterally strike the oil phase to mix with the oil phase to form a first-stage coarse emulsion, and a first orifice plate configured to allow the first-stage coarse emulsion to spout from the first orifice plate and into a second stage coarse emulsion mixer, (b) the second stage coarse emulsion mixer equipped with:

a second stage adjustment of flow rate configured to control a second part of the water phase to flow into the second stage coarse emulsion mixer, a second diversion port configured to laterally introduce the second part of the water phase into the second stage coarse emulsion mixer, a second jet hole configured to cause the second part of the water phase to spout from the second jet hole at a certain flow velocity and to laterally strike the first-stage coarse emulsion to mix with the first-stage coarse emulsion to form a second-stage coarse emulsion, and a second orifice plate configured to allow the second-stage coarse emulsion to spout from the second orifice plate and into a third stage coarse emulsion mixer, (c) the third stage coarse emulsion mixer equipped with:

a third stage adjustment of flow rate configured to control a third part of the water phase to flow into the third stage coarse emulsion mixer, a third diversion port configured to laterally introduce the third part of the water phase: into the third stage coarse emulsion mixer, a third jet hole configured to cause the third part of the water phase to spout from the third jet hole at a certain flow velocity and to laterally strike the second-stage coarse emulsion to mix, with the second-stage coarse emulsion to form a third-stage coarse emulsion, and a third orifice plate, (d) a fourth stage coarse emulsion mixer equipped with a fourth stage adjustment of flow rate, a fourth diversion port, a fourth jet hole, and a fourth orifice plate, and (e) a fifth stage coarse emulsion mixer equipped with a fifth stage adjustment of flow rate, a fifth diversion port, a fifth jet hole, and a fifth orifice plate, wherein:

every two adjacent stages of coarse emulsion mixers are connected in series, and a longitudinal axis through the oil inlet is transverse to each longitudinal axis through at least the first diversion port, the second diversion port, and the third diversion port, and (iv) a fine emulsion mixer connected to the fifth stage coarse emulsion mixer.

2. The emulsifying device for an emulsion explosive of claim 1, wherein a sum of flow rates under the control of the first stage adjustment of flow rate, the second stage adjustment of flow rate, the third stage adjustment of flow rate, the fourth stage adjustment of flow rate, and the fifth stage adjustment of flow rate corresponds to a total flow rate under the control of the total water phase flow rate regulating pump, and the flow rates among all stages of flow rate adjustment are allocated proportionately.

3. The emulsifying device for an emulsion explosive of claim 1, wherein the fine emulsion mixer is a static mixer or a Venturi tube.

4. The emulsifying device for an emulsion explosive of claim 3, wherein the total flow rate of the oil phase regulated by the oil phase flow rate regulating pump and the total flow rate of the water phase regulated by the total water phase flow rate regulating pump are 4%-10% and 90%-96% in weight percentage, respectively.

* * * * *